US008506241B1

(12) United States Patent
Liang

(10) Patent No.: US 8,506,241 B1
(45) Date of Patent: Aug. 13, 2013

(54) TURBINE BLADE WITH COOLING AND TIP SEALING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 565 days.

(21) Appl. No.: 12/909,372

(22) Filed: Oct. 21, 2010

(51) Int. Cl.
*F01D 5/18* (2006.01)
*F01D 5/20* (2006.01)

(52) U.S. Cl.
USPC ..... 415/115; 415/173.1; 416/90 R; 416/92; 416/97 R

(58) Field of Classification Search
USPC ..... 416/90 R, 92, 95, 96 R, 96 A, 97 R; 415/115, 173.1
See application file for complete search history.

(56) References Cited

U.S. PATENT DOCUMENTS 3,066,910 A * 12/1962 Bluck ..... 416/92
5,702,232 A * 12/1997 Moore ..... 416/95
7,029,235 B2 * 4/2006 Liang ..... 416/92

* cited by examiner

*Primary Examiner* — Christopher Verdier
(74) *Attorney, Agent, or Firm* — John Ryznic

(57) ABSTRACT

A turbine rotor blade with a hollow open cavity formed between the airfoil walls, and radial flow near wall cooling channels formed within the walls that open on the tip surface to discharge the cooling air for sealing of the tip. The radial channels have a converging flow area to increase the cooling air flow velocity, and the radial cooling channels on the pressure side wall are slanted toward the pressure side so that the discharged cooling air will produce a smaller vena contractor and further reduce tip leakage flow.

3 Claims, 1 Drawing Sheet

TURBINE BLADE WITH COOLING AND TIP SEALING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade with both near wall cooling of the airfoil and sealing of the blade tip.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

For a blade cooled with radial flow channels formed within the walls, the near wall radial flow channel at the blade tip discharge section experiences an external cross flow effect. As a result of this cross flow effect, an over-temperature occurs at the locations of the blade tip on the pressure wall side. This external cross flow effect on the near wall radial flow channel is caused by a non-uniformity of the radial channel discharge pressure profile and the blade tip leakage flow across the radial channel exit location.

One process for cooling a turbine rotor blade is disclosed in U.S. Pat. No. 5,702,232 issued to Moore on Dec. 30, 1997 and entitled COOLED AIRFOILS FOR A GAS TURBINE ENGINE. In the Moore blade cooling design, the blade mid-chord section is cooled with a number of radial extending single pass cooling channels that open onto the blade tip. A radial cooling channel can be of a race-track shape instead of circular. Film cooling holes are also connected to the radial cooling channels to discharge layers of film cooling air onto the external blade surface. In this design, cooling flow velocity decreases with passage through the channel and thus the internal heat transfer coefficient is reduced. Cooling air refresh holes are therefore used that bring cooling air from a central cavity and into the radial cooling channels to replenish the cooling air flow.

BRIEF SUMMARY OF THE INVENTION

A turbine rotor blade with a hollow cavity opening at the blade tip, with the airfoil walls having a number of radial extending near wall cooling channels that open onto the tip to discharge cooling air for sealing of the blade tip. The radial channels have a decreasing cross sectional area so that the flow increases to increase the heat transfer rate. And, the cooling channels on the pressure side wall are angled toward the front or pressure side so that the cooling air discharged at the tip will form a smaller vena contractor and further decrease leakage flow through the tip gap.

DETAILED DESCRIPTION OF THE INVENTION

The blade tip leakage flow problem and cooling channel external cooling flow mal-distribution issues of the prior art can be alleviated by the sealing and cooling geometry of the present invention. An internal convergent flow channel with the surface slanted toward the blade pressure side tip corner is formed within a convergent cooling channel. The internal slant surface of the cooling channel wall will function as a cooling flow deflector while the slanted blade cooling channel exit pinches the leakage flow across the tip gap and eliminates the cross flow effect.

Figure 2:
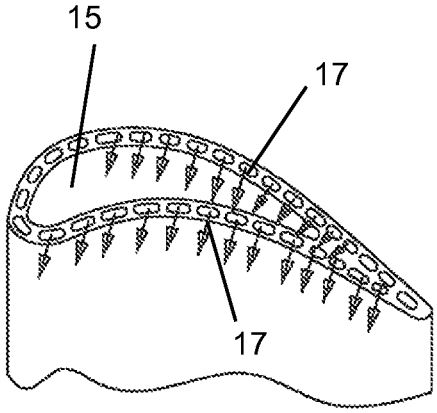
FIG. 2 shows a top view of the blade of FIG. 1 with the radial cooling channels opening on the tip surface.
Figure 1:
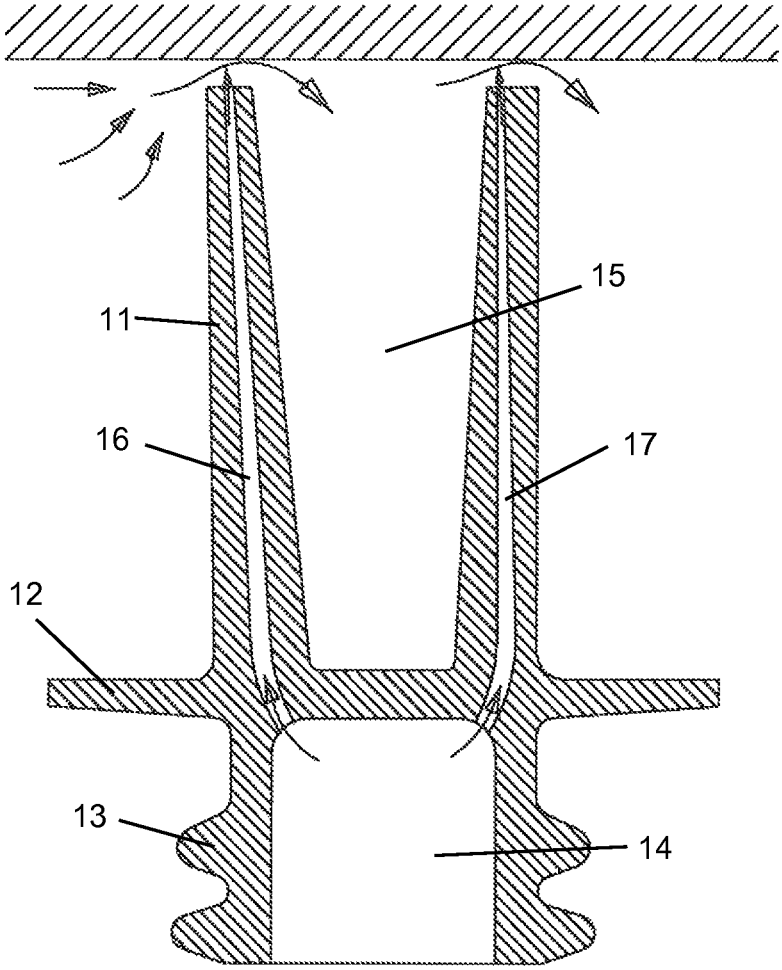
FIG. 1 shows a cross section view of the blade of the present invention with radial cooling channels on the pressure side wall and the suction side wall that both open at the tip.

The blade 11 is shown in FIG. 1 with a pressure side wall having a radial flow cooling channel 16 and the suction side wall with a radial flow cooling channel 17 in which both channels 16 and 17 open onto the tip surface. A hollow cavity 15 is formed within the walls of the blade. The blade includes a platform 12 and a root 13 with a cooling air supply cavity 14 connected to the radial cooling channels that extend around the airfoil as seen in FIG. 2. The radial near wall cooling channels 16 and 17 are without any film cooling holes or replenishing cooling air holes so that all of the cooling air supplied to the channels will be discharged at the tip surface for leakage control. Also, because of the convergence of the radial cooling channels, better near wall cooling of the airfoil walls occurs.

The radial cooling channels 16 within the pressure side wall all slant toward the pressure side of the airfoil. The radial cooling channels 17 within the suction side wall are directed straight up or along the radial direction of the blade. However, the S/S channels 17 can also slant toward the pressure side of the airfoil like the P/S channels 16. Also, both the P/S and S/S channels have a convergent flow area that decreases toward the tip so that the cooling air flow will be accelerated. The cooling flow channels are angled toward the front or pressure side of the blade so that the cooling air discharged at the tip will form a smaller vena contractor and further decrease leakage flow through the tip gap.

In operation, due to the pressure gradient across the airfoil from the pressure side of the blade to the downstream section of the suction side, the secondary flow near the pressure side wall will migrate from a lower blade span upward across the blade tip. The near wall secondary flow will follow the contour of the concave pressure side surface on the airfoil peripheral and flow upward and across the blade tip crown. At the same time, the multiple near wall convergent cooling channels with a slant toward the pressure side of the blade will accelerate the cooling air toward the pressure side surface and form an "air curtain" against the oncoming hot gas leakage flow passing through the tip gap. The counter flow action will reduce the oncoming leakage flow as well as push the leakage flow outward to the blade outer air seal (BOAS). In addition to the counter flow, the slanted blade cooling channels will force the secondary flow outward as the leakage flow enters the pressure side tip corner and form a smaller vena contractor and therefore reduce the effective leakage flow area. A similar construction can also be used on the suction side radial cooling channels. Pin fins can also be used in the convergent radial cooling flow channels to enhance the heat transfer coefficient of the near wall cooling channels. The result of all of the above described structure is to reduce the blade leakage flow and provide better cooling for the blade. The formation of the tip leakage flow resistance by the blade near wall cooling channels and cooling flow discharge will yield a very high resistance for the leakage flow path and therefore reduce the blade leakage flow. This will reduce the blade tip section cooling flow mal-distribution problem described in above and prolong the blade useful life.

I claim the following:

1. A turbine rotor blade comprising:

a root and platform with a cooling air supply cavity formed within the root;

an airfoil section extending from the root with a pressure side wall and a suction side wall forming a hollow cavity that is open on a tip of the blade;

a plurality of radial near wall cooling channels formed within the pressure and suction side walls and open at the tip surface;

the plurality of radial near wall cooling channels having a converging area such that cooling air flow will be accelerated; and, the radial near wall cooling channels formed within the pressure side wall are slanted toward the pressure side of the blade such that a smaller vena contractor is formed in a tip gap.

2. The turbine rotor blade of claim 1, and further comprising:

the radial near wall cooling channels are without film cooling holes.

3. The turbine rotor blade of claim 1, and further comprising:

the radial near wall cooling channels have a racetrack cross sectional shape with a longer side extending substantially parallel to the airfoil surface.

* * * * *